US009445629B2

(12) United States Patent
Steinberg

(10) Patent No.: US 9,445,629 B2
(45) Date of Patent: Sep. 20, 2016

(54) VAPORIZATION PIPE WITH IMPROVED FILTER UNIT

(75) Inventor: Dan Steinberg, Blacksburg, VA (US)

(73) Assignee: VaporGenie LLC, Blacksburg, VA (US)

( * ) Notice: Subject to any disclaimer, the term of this patent is extended or adjusted under 35 U.S.C. 154(b) by 909 days.

(21) Appl. No.: 13/347,506

(22) Filed: Jan. 10, 2012

(65) Prior Publication Data

US 2012/0174935 A1 Jul. 12, 2012

Related U.S. Application Data

(60) Provisional application No. 61/461,052, filed on Jan. 12, 2011.

(51) Int. Cl.

| | |
|---|---|
| ***A24F 47/00*** | (2006.01) |
| ***A24F 1/32*** | (2006.01) |
| ***A24F 5/00*** | (2006.01) |

(52) U.S. Cl.

CPC . *A24F 1/32* (2013.01); *A24F 5/00* (2013.01); *A24F 47/00* (2013.01)

(58) Field of Classification Search

None

See application file for complete search history.

(56) References Cited

U.S. PATENT DOCUMENTS

| | | | | |
|---|---|---|---|---|
| 2,068,866 A * | 1/1937 | Pedery et al. | ..... | 131/206 |
| 2,431,586 A * | 11/1947 | Rydholm | ..... | 131/216 |
| 2,637,327 A * | 5/1953 | Nadelson | ..... | 131/196 |

* cited by examiner

*Primary Examiner* — Michael J Felton

(74) *Attorney, Agent, or Firm* — Dan Steinberg

(57) ABSTRACT

Provided is filter unit for a vaporization pipe having improved reliability and manufacturability and lower cost. The present filter unit comprises a wooden filter housing with a through hole. A metal insert fitting is press fit into the hole. A ceramic foam flame filter is disposed inside the insert fitting. The insert fitting preferably has a step ledge for supporting the ceramic foam filter. The metal fitting preferably has a flange (external to the wood filter housing) for improving the stability of the mechanical connection between the insert fitting and filter housing. This design allows for fast assembly with a minimum of labor. Stress and damage to the wood is minimized. The filter housing can have a vertical/longitudinal wood grain direction (parallel with the filter housing hole), thereby reducing the cost of the wood parts and improving the finished appearance.

29 Claims, 11 Drawing Sheets

Spiralled ridges

Knurled

Bumps

Segmented ridges

VAPORIZATION PIPE WITH IMPROVED FILTER UNIT

RELATED APPLICATIONS

The present application claims the benefit of priority from provisional patent application 61/461,052 filed on Jan. 12, 2011, which is hereby incorporated by reference.

FIELD OF THE INVENTION

The present invention relates generally to smoking devices and vaporization devices. More particularly, the present invention relates to a vaporization pipe having a more reliable and manufacturable filter unit.

BACKGROUND OF THE INVENTION

Tobacco and other herbs are typically smoked by burning and inhaling the combustion fumes and smoke. In recent years, interest has grown in the technique of vaporization in which the smoking material is carefully heated so that the desired flavor and psychoactive components are liberated, and combustion is minimized.

Vaporization provides many benefits over smoking. Vaporization produces much less toxic and carcinogenic pyrolytic products compared to smoking. Also, vaporization is smoother and more flavorful, and lacks the disagreeable burned taste produced by conventional smoking. Further, vaporization allows more efficient use of smoking materials, since desired flavor and psychoactive compounds are not destroyed by combustion.

However, vaporization is difficult to perform, since vaporization only occurs in a relatively narrow temperature range. If the temperature is too low, desired compounds are not vaporized and nothing is inhaled; if the temperature is too high, combustion will occur. For most smoking materials, vaporization is optimal in a temperature range of about 300-400 degrees Fahrenheit. The optimal temperature depends upon the compounds being vaporized.

U.S. Pat. No. 7,434,584 teaches a portable and effective vaporization pipe that has found significant market success. The top filter unit of this pipe presents some manufacturing difficulties that are explained in reference to FIG. 1. A filter housing 10 is made of wood. A porous ceramic foam filter element 12 and eyelet 13 are disposed in the filter housing. A male threaded ring 14 is tightly screwed into the wood housing 10. A few turns of the threaded ring are exposed for attachment to a female-threaded bowl (not shown). This design is cost effective and functional, but it has several problems:

1) The filter housing must have threads cut into the wood. The thread cutting process is slow and labor-intensive. Also, thread cutting causes chipping and damage to the wood edges.

2) Thread cutting requires the wood fibers to be oriented perpendicular to the central hole (i.e. in a horizontal/transverse direction). This increases the cost of the filter housing, and increases the difficulty of fabricating the filter housing part. Also, wood parts with this unusual wood fiber orientation are more difficult to finish and have a less attractive finished appearance.

3) The process of inserting the threaded ring and screwing it tightly is slow and labor intensive, and tends to damage the wood parts.

4) The tightly screwed threaded tube tends to cause the filter housing to crack and split, because the tube produces a large outward force on the inside surface of the filter housing. This reduces the reliability and durability of the product, and increases warranty replacement costs.

Accordingly there is a need for an improved filter unit design that is easier and faster to manufacture, and that has a lower defect rate.

SUMMARY

The present invention provides a filter unit that is attachable to a vaporizing pipe. The filter unit comprises a filter housing having a hole with an inlet and outlet. The hole extends through the filter housing. A flame filter is disposed in the hole, between the inlet and outlet. An insert fitting is also disposed in the hole. The insert fitting comprises 3 parts: a tube portion, a male threaded portion, and a flange. The tube portion is disposed in the hole and attached to an inner surface of the hole. The male threaded portion is disposed external to the hole. Also, the flange is external to the hole. Preferably, the flange is abutted to an external surface of the filter housing.

The flame filter can comprise any of the flame filter materials described in U.S. Pat. No. 7,434,584, which is incorporated by reference. The flame filter can be made of open cell ceramic foam, such as open cell silicon carbide foam.

The insert fitting can be attached to the hole by interference fit. Preferably, an external surface of the tube portion has textured or rough surface features to improve the interference fit with the filter housing. The surface features can be ridges, bumps, knurling or other surface projections. The tube portion can additionally or alternatively be attached to the filter housing with adhesive.

Preferably, an inner surface of the tube portion includes a step ledge for supporting the flame filter.

Preferably, the flange has an outer diameter (OD) that is greater than an inner diameter (ID) of the filter housing hole.

Preferably, the filter housing is made of wood, and has a wood grain direction that is parallel with the hole.

FIGS. **6*a*-6*d*** illustrate variations of texturing of the external surface of the insert fitting.

Figure 7:
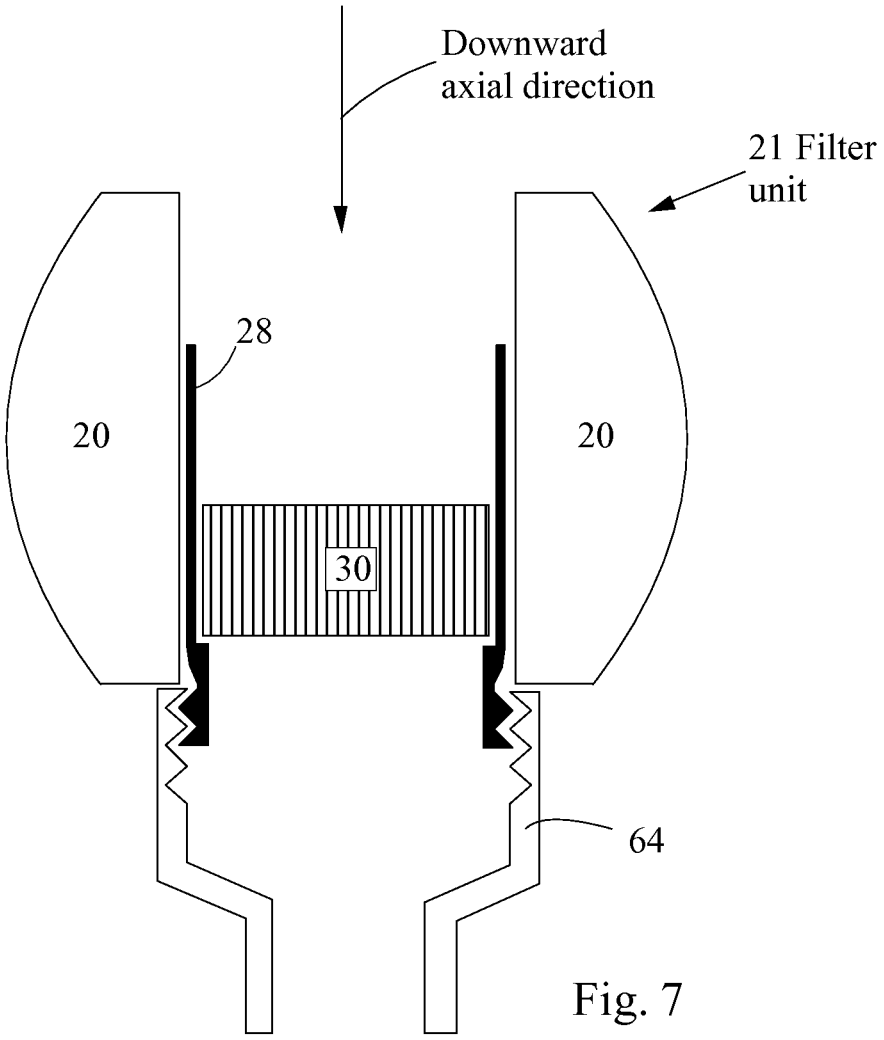

FIG. 7 shows an embodiment lacking a flange.

Figure 8:
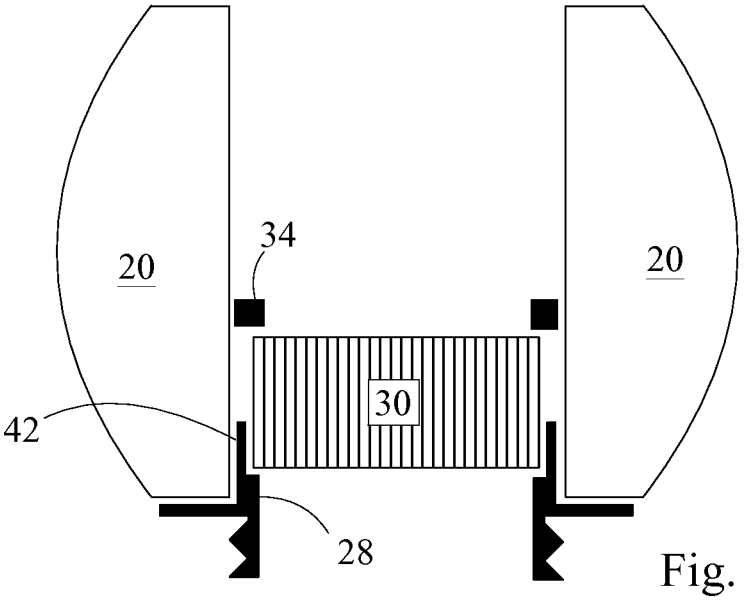

FIG. 8 shows an embodiment in which the flame filter is only partially disposed in the insert fitting.

Figure 9:
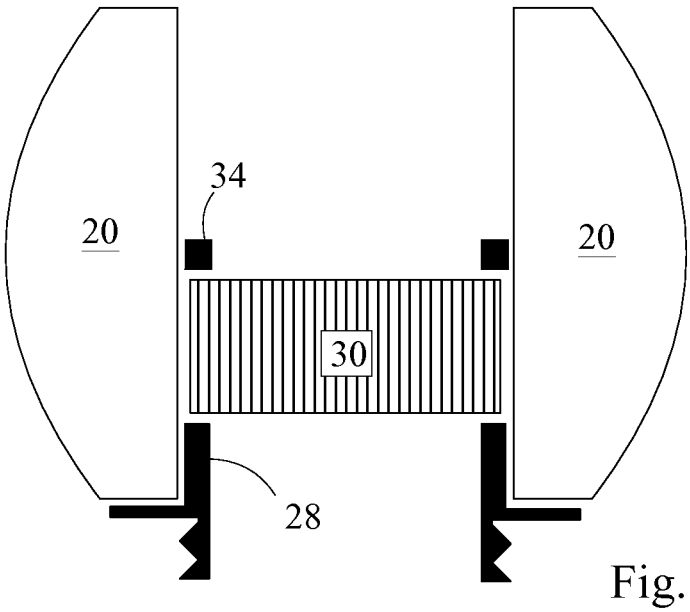

FIG. 9 shows an embodiment in which the flame filter is disposed on top of the insert fitting.

Figure 10:
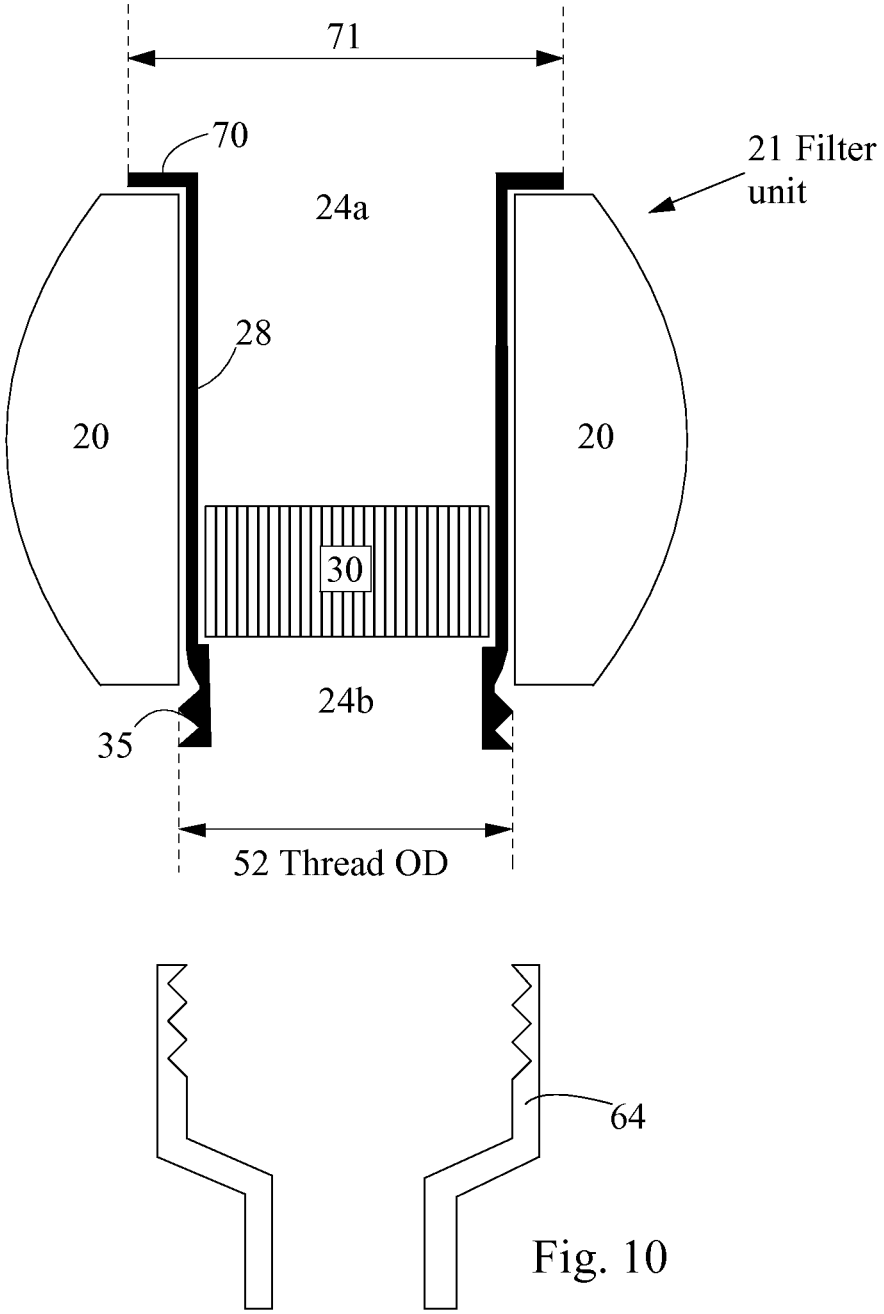

FIG. 10 shows an embodiment in which the insert fitting has an eyelet portion.

Figure 11:
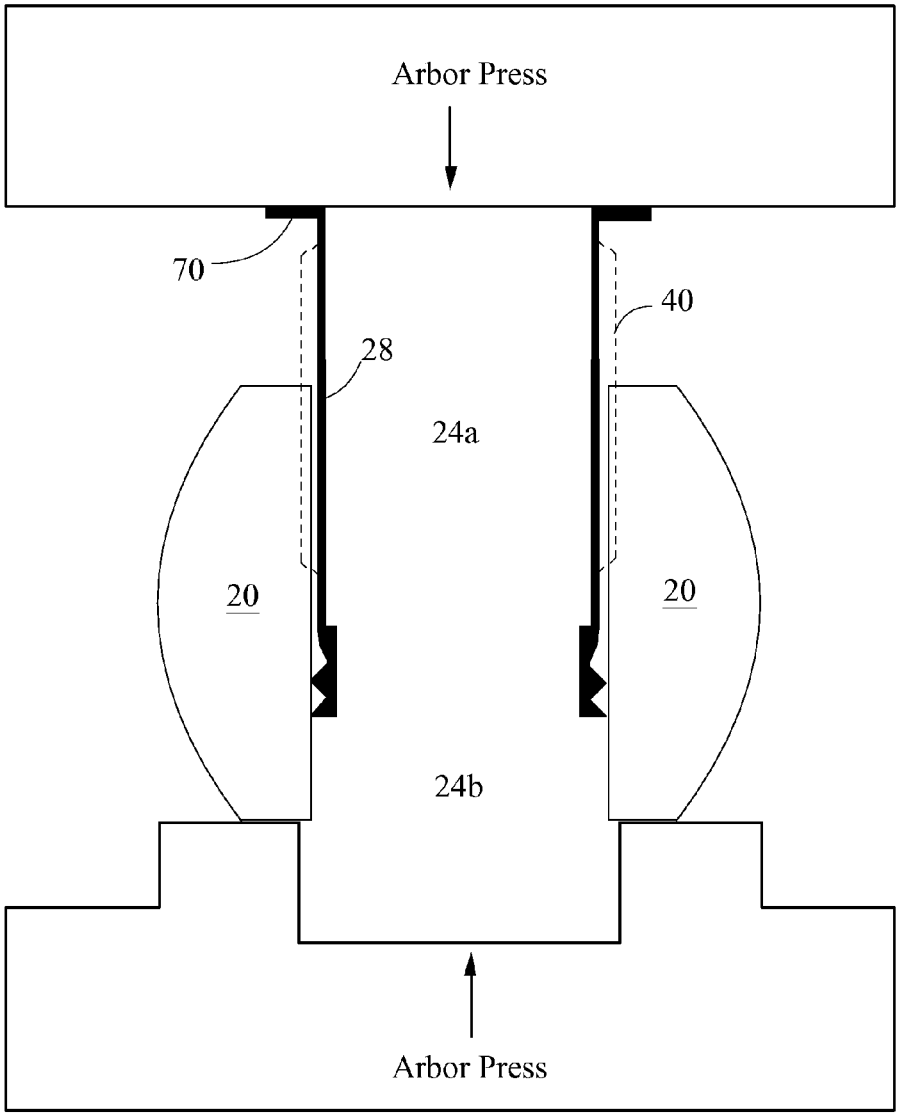

FIG. 11 illustrates a preferred method for attaching the filter housing and the insert fitting of FIG. 10.

Figure 12:
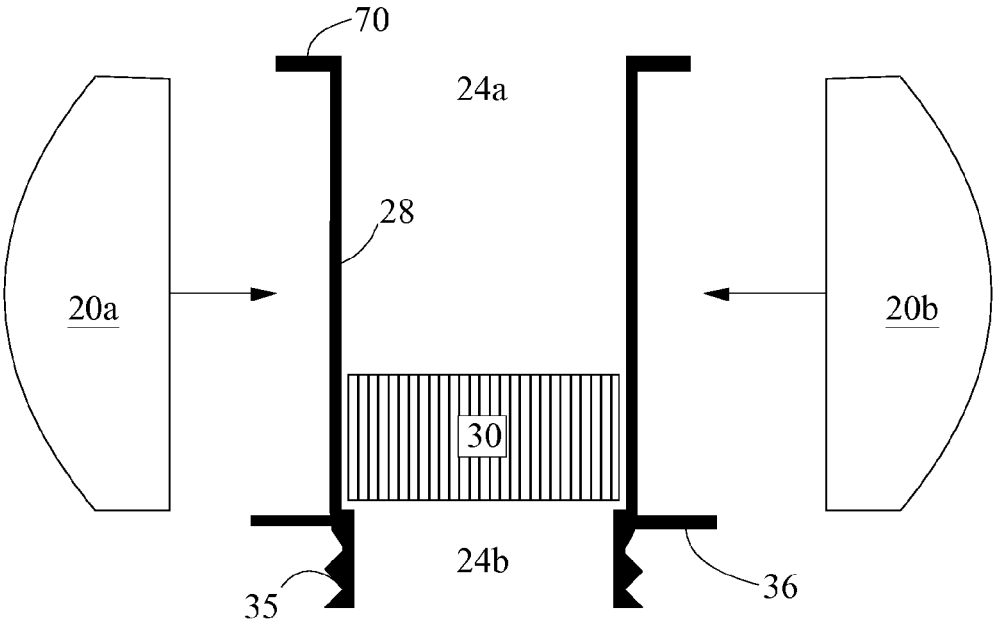

FIG. 12 shows an embodiment in which the insert fitting has both an eyelet portion and a flange.

Figure 13:
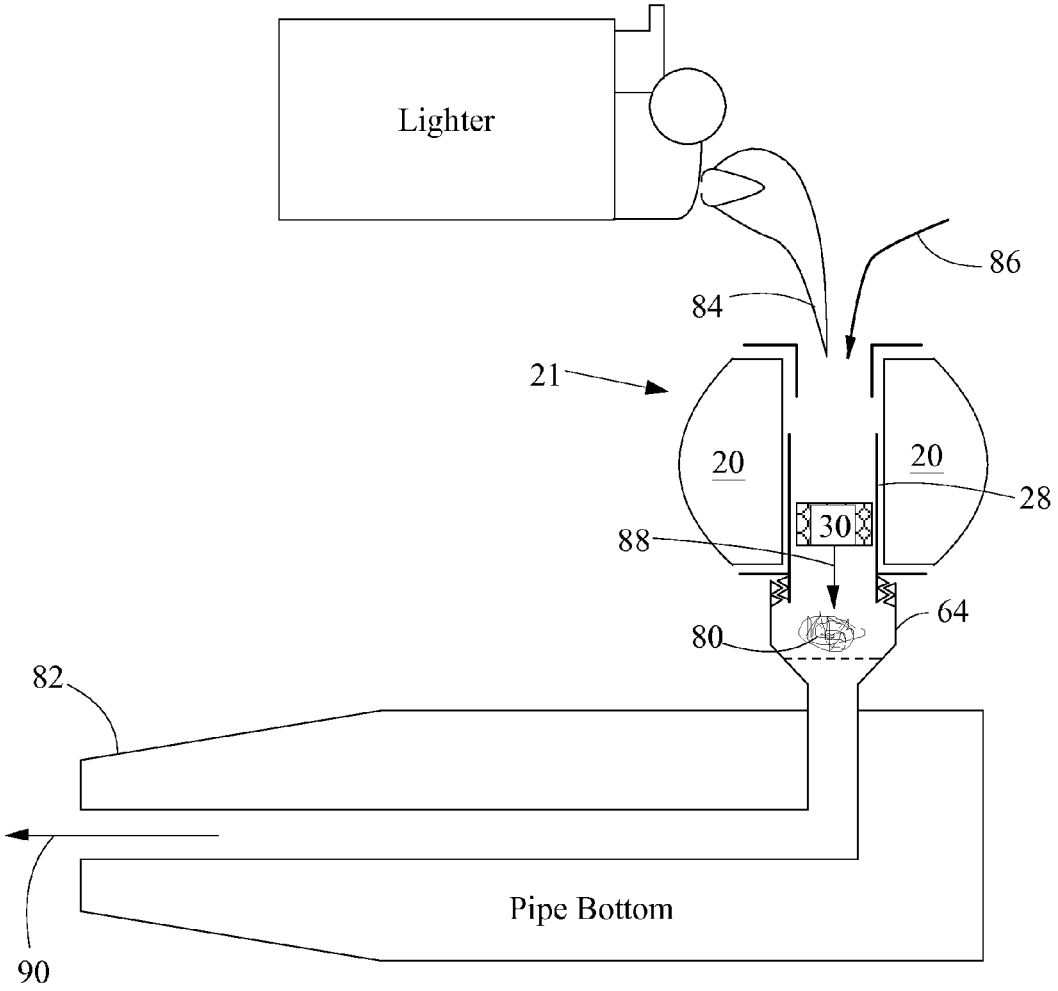

FIG. 13 shows the present vaporizing pipe in use.

DETAILED DESCRIPTION

The present invention provides a filter unit with improved reliability and manufacturability and lower cost. The present filter unit comprises a filter housing (e.g. made of wood) with a through hole. An insert fitting (e.g. made of metal) is attached to an inner surface of the hole. An external surface of the insert fitting can have ridges, knurling, bumps or other rough features that create a strong interference fit attachment with the filter housing. A ceramic foam flame filter is disposed inside the insert fitting. The insert fitting preferably has a ledge for supporting the ceramic foam filter. Also, the insert fitting preferably has a flange (external to the wood filter housing) for improving the stability of the mechanical connection between the fitting and filter housing. This design allows for fast assembly with a minimum of labor. Stress and damage to the wood is minimized. Further, a vertical/longitudinal wood grain direction can be used in this design, thereby reducing the cost of the wood parts and improving the finished appearance.

DEFINITIONS

Interference fit: non-threaded attachment between two parts achieved by space interference between the two parts.

Figure 1:
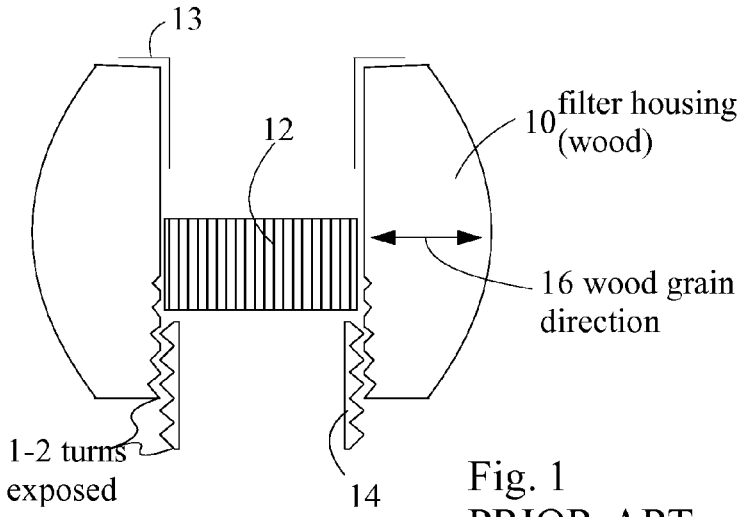
Fig. 1 PRIOR ART
FIG. 1 (Prior Art) shows a filter unit according to the prior art. The filter unit has a threaded metal tube screwed into the wooden filter housing.
Figure 2:
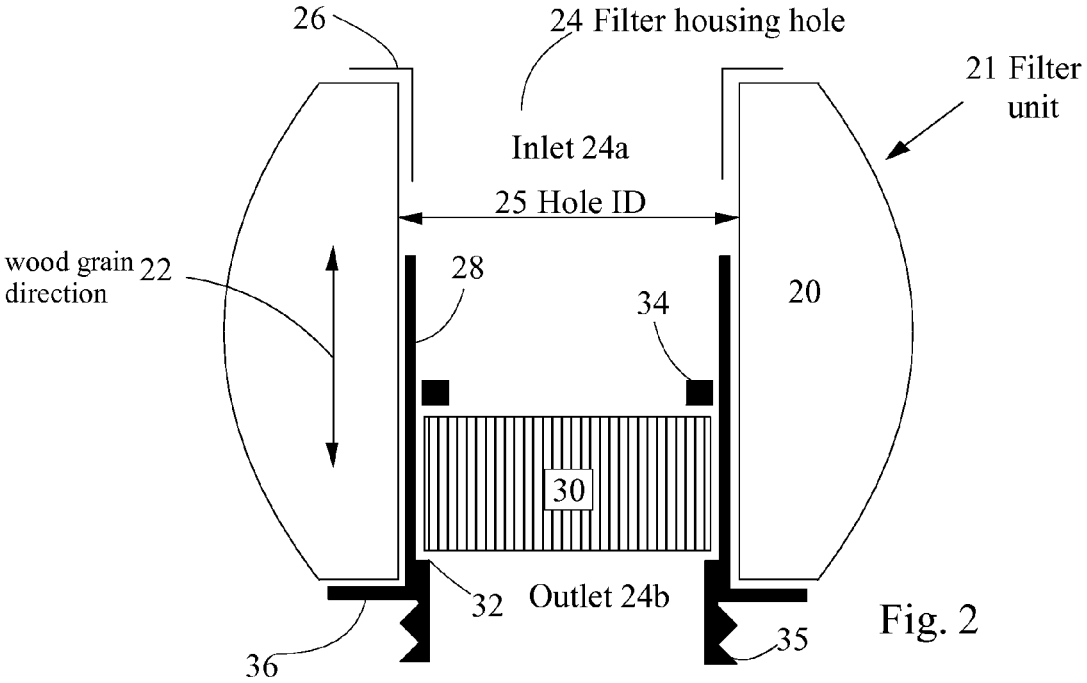
FIG. 2 shows a filter unit according to the present invention.

FIG. 2 shows a filter unit 21 according to a preferred embodiment of the present invention. The filter unit comprises a filter housing 20, preferably made of wood. The filter housing has a filter housing hole 24 that extends through the filter housing 20. The filter housing hole comprises inlet 24*a* and outlet 24*b* that are fluidically connected. The filter housing hole has an inner diameter (ID) 25. A metal eyelet 26 is disposed at the inlet 24*a* and protects the wood from applied flame. An insert fitting 28 is disposed in the filter housing hole 24. The insert fitting 28 is attached to the filter housing by interference fit (e.g. attached by "press-fit"). Alternatively or additionally, adhesive (e.g. high temperature epoxy) can be used to bond the insert fitting 28 and housing 20.

A ceramic foam flame filter 30 is disposed inside the insert fitting 28. Preferably, a step ledge 32 is present on an internal surface of the fitting 28 for supporting the ceramic filter 30. A retaining ring 34 is preferably provided for holding the ceramic filter 30 inside the fitting 28 and against the step ledge 32. The retaining ring 34 is held in place by friction against the inner surface of the fitting 28.

The fitting 28 has male threads 35 for attachment to a bowl (not shown) having female threads.

The fitting preferably has a flange 36. The flange 36 is external to the filter housing 20 and extends over a bottom surface of the filter housing. The flange 36 stabilizes the connection between the fitting 28 and filter housing 20. Specifically, the flange 36 prevents the fitting 28 from twisting, tilting or being pulled out, as described below. The flange 36 can have a planar shape, as shown, or a conical or curved shape. The thickness of the flange 36 can be about 0.010-0.10 inches, for example.

Preferably, the filter housing has a vertical wood grain orientation 22 as shown in FIG. 2. A vertical wood grain orientation is parallel to the filter housing hole 24. However, this wood grain orientation is optional. The filter housing can also have a horizontal wood grain orientation (with grains perpendicular to the hole) or any other wood grain orientation.

The filter housing 20 can be made of materials other than wood. For example, the filter housing can be made of polymeric materials, for example high temperature resistant polymers such as silicone, phenolic resins or phenolic composites. The filter housing 20 can also be made of stone, brick, ceramic, metals, glass or the like. Preferably the filter housing has a relatively low thermal conductivity.

The flame filter 30 can comprise many different materials and structures. Materials suitable for use as the flame filter are described in U.S. Pat. No. 7,434,584, which is hereby incorporated by reference in its entirety. Exemplary materials that can be used for the flame filter include ceramic foams, silicon carbide foam, metal foams, glass foams, bonded granules (e.g. glass, metals or ceramics), stacks of plates or screens, metal wire, or other porous materials with tortured flow paths. The claims are not limited in the types of materials that can be used for the flame filter.

The insert fitting 28 can be cast and/or machined and can be made of many different metals. Stainless steel is a preferred material. Other suitable materials include zinc, brass, aluminum, or steel for example. The fitting 28 can also be made of a ceramic material. The claims are not limited in the types of material used for the insert fitting 28.

The retaining ring 34 can be made of steel or stainless steel wire for example. It can have a single loop or multiple loops. Optionally, the inner surface of the fitting 28 has a groove (not shown) for receiving the retaining ring, as known in the art.

Figure 3:
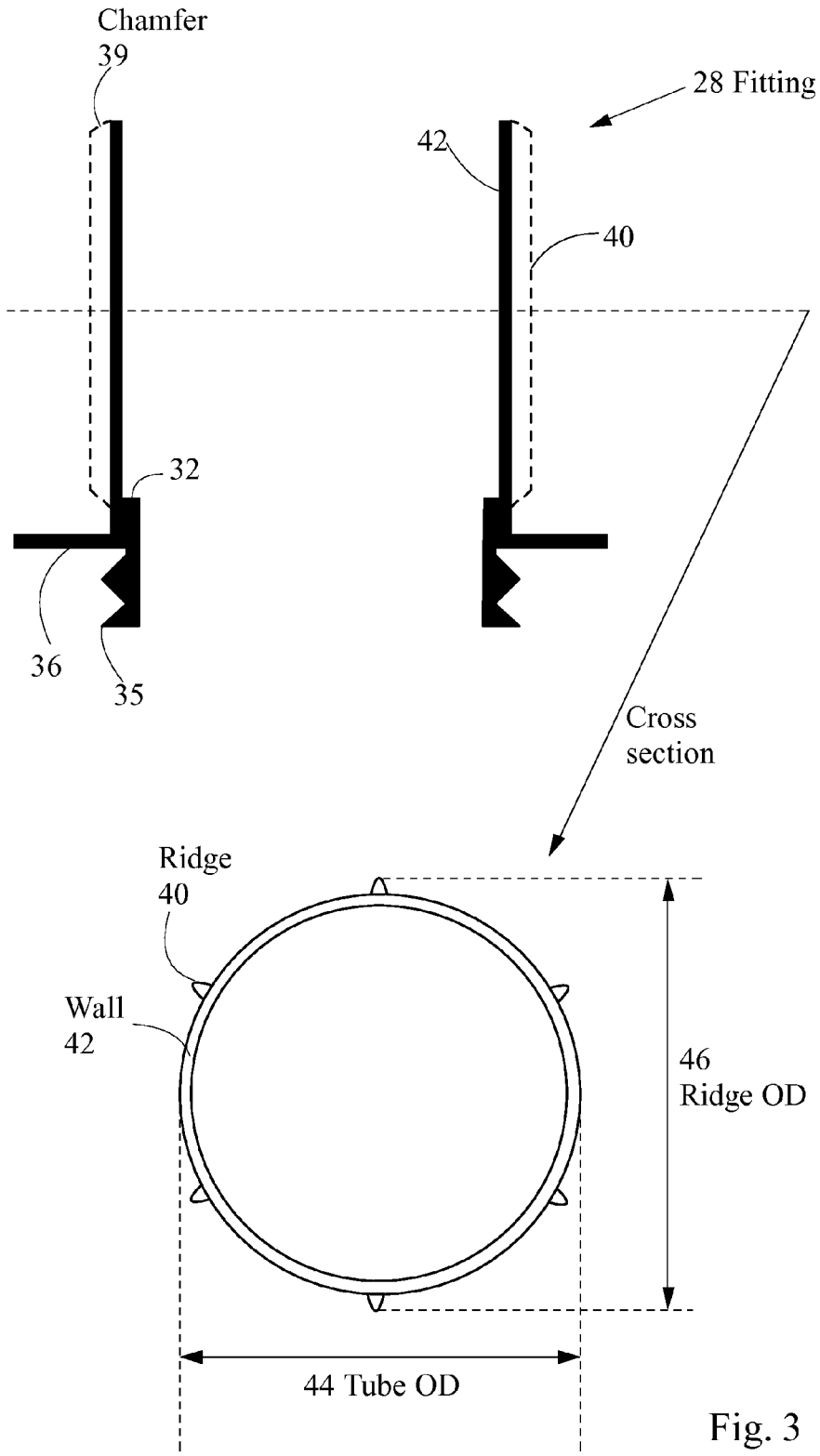
FIG. 3 shows an insert fitting according to an embodiment of the invention.

FIG. 3 shows a closeup side view and cross sectional view of the fitting 28. The fitting 28 comprises a tube wall portion 42, with ridges 40 on an exterior surface of the tube wall 42. The fitting can have about 1-10 ridges for example; the embodiment of FIG. 3 has 6 ridges.

The tube wall 42 can have a thickness of about 0.010-0.100 inches, for example, though the claims are not limited to this thickness range. The tube wall has an outer diameter (OD) 44 that is preferably equal to or slightly smaller than the filter housing hole ID 25. If the tube wall OD 44 is greater than the filter housing hole ID, there is a danger of the filter housing 20 splitting or cracking during assembly, or excessive force being required for assembly. The tube wall OD can be about 0.000-0.050 inches smaller than the filter housing hole 24 ID for example, though the appended claims are not so limited. Alternatively, the tube wall OD can be slightly greated than the hole ID 25.

The fitting 28 has a ridge OD 46. Preferably, the ridge OD is slightly greater than the ID of the filter housing hole 24. Consequently, the ridges 40 dig into the filter housing 20 during assembly, as explained below. In other words, the ridges 40 create an interference fit with the filter housing hole 24. The ridge OD 46 can be about 0.001-0.075 inches greater than the filter housing hole 24 ID, which will cause the ridges to dig into the filter housing 20 by about 0.0005-0.037 on each side. The optimal amount of oversizing (interference) depends on the physical properties (e.g. hardness, strength, toughness) of the insert fitting 28 and filter housing 20.

The appended claims are not limited to specific values of tube wall OD or ridge OD or the amount of oversizing or undersizing of these dimensions relative to the filter housing hole ID.

The filter housing hole 24 ID, tube wall OD and ridge OD can be in the range of about 0.20-1 inch for example.

In a preferred embodiment, a top/leading edge of the ridges 40 and tube wall 42 are chamfered 39 to facilitate insertion into the filter housing 20.

Figure 4:
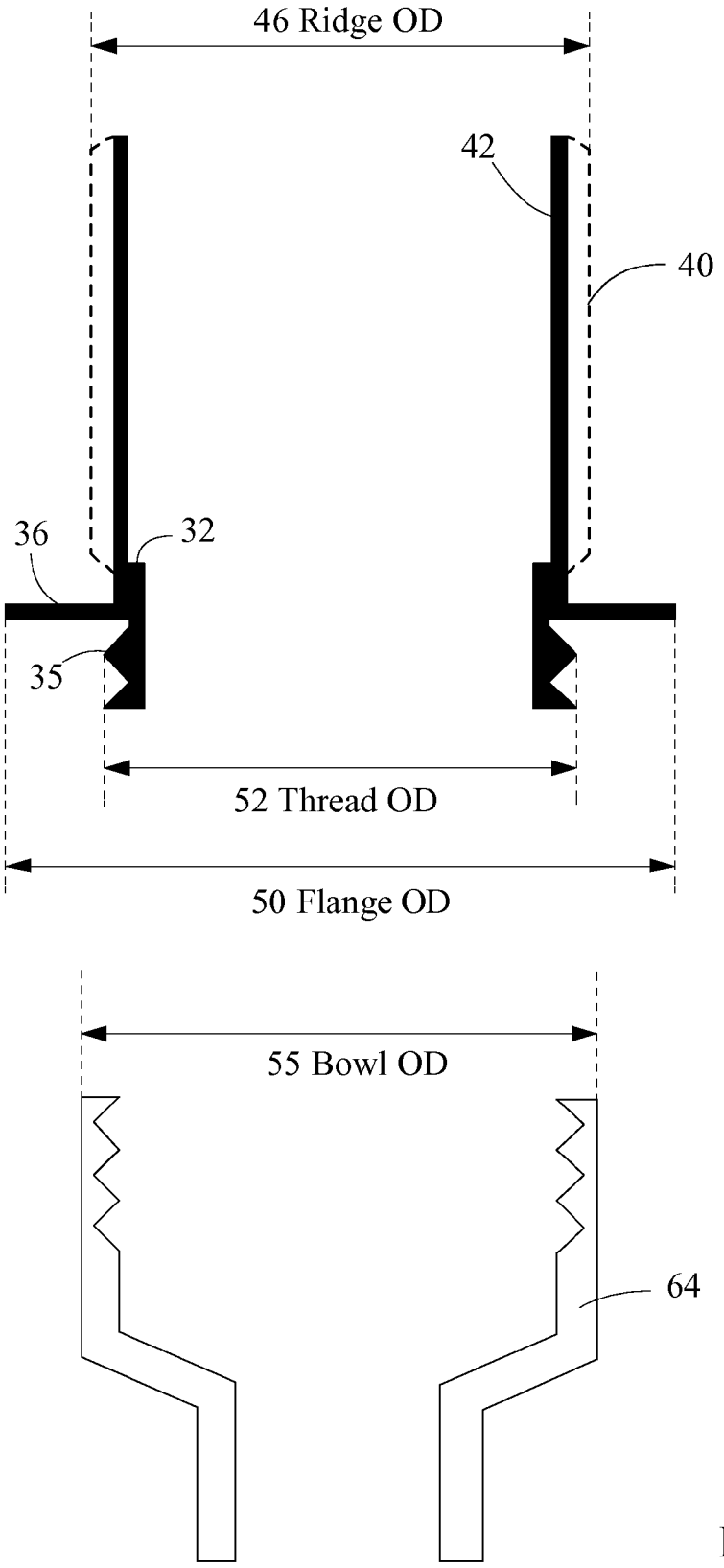
FIG. 4 illustrates some optional dimensional features of the insert fitting.

FIG. 4 also shows a closeup view of the same embodiment of the fitting 28 illustrated in FIG. 3. Also shown is a bowl 64 for threaded attachment to the male threads 35. The flange 36 has a flange OD 50, and the male threads 35 have a thread OD 52. Preferably, the flange OD 50 is equal to or greater than the thread OD 52. Also preferably, the flange OD is equal to or greater than the ridge OD 46.

The bowl 64 has a bowl OD 55. Preferably, the flange OD 50 is equal to or greater than the bowl OD 55.

A flange with a sufficiently large OD (e.g. exceeding the flange OD 50 or bowl OD 55) will stabilize the connection between the fitting 28 and filter housing 20. Also, a sufficient flange OD will prevent the flange 36 from becoming jammed in female threads of the bowl 64.

Figure 5:
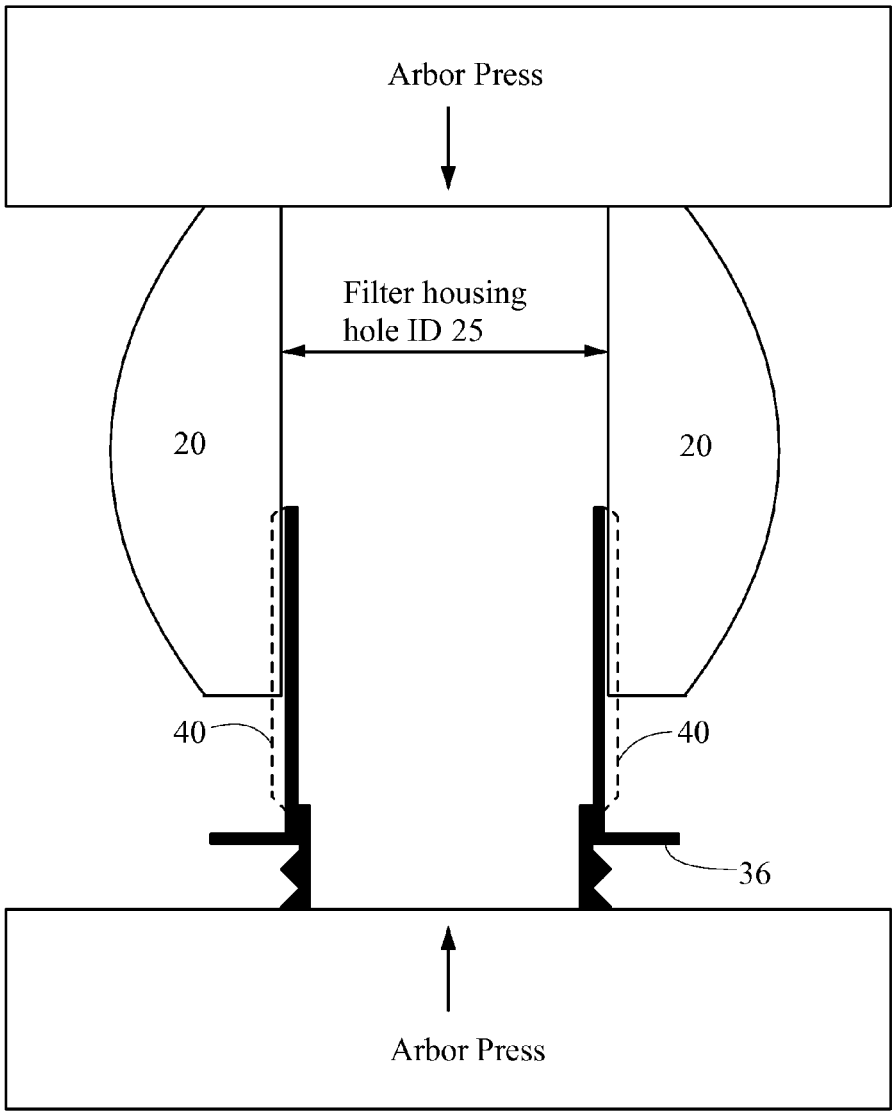
FIG. 5 illustrates a preferred method for connecting the insert fitting and the filter housing.

FIG. 5 illustrates a preferred method for assembling the present filter unit. In this method, the insert fitting 28 is pressed into the filter housing 20 with a mechanical press. For example, an arbor press or hydraulic press can be used. During the pressing operation, the ridges 40 dig into the filter housing 20, creating a strong interference/friction fit. The fitting 28 is inserted into the filter housing 20 until the flange 36 meets the bottom surface of the filter housing 20.

The ceramic flame filter 30, retaining ring 34 and eyelet 26 can be added before or after the fitting 28 is inserted into the filter housing 20.

Figure 6A:
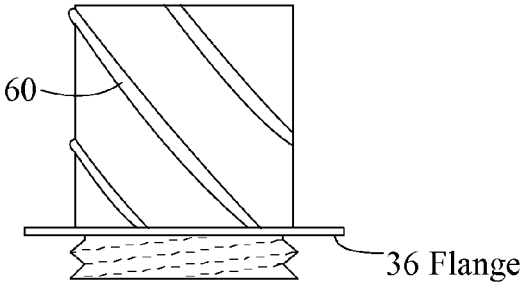
Figure 6B:
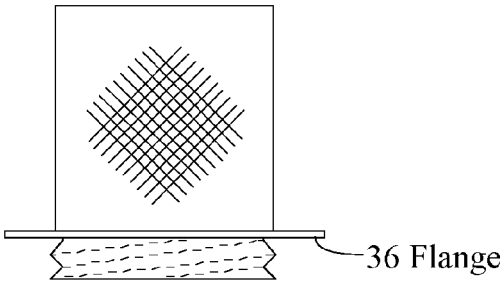
Figure 6C:
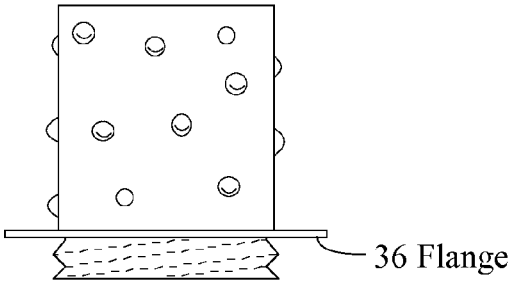
Figure 6D:
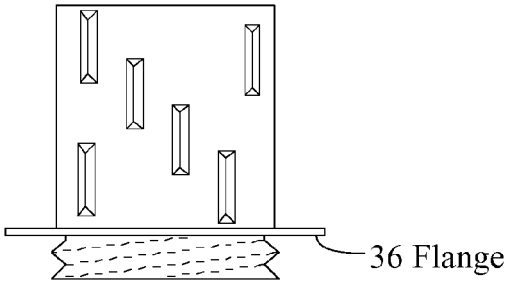

In alternative embodiments, the ridges 40 are replaced with other mechanical features that dig into the filter housing 20 material and provide an interference/friction fit. For example, the straight ridges 40 can be replaced with bumps, spiral ridges or knurling, for example. Any type of roughened, bumpy, textured, grooved or ridged surface can be used. The appended claims are not limited to fittings that have straight ridges as shown in FIGS. 3 and 4. FIG. 6*a*-6*d* show various types of roughened surfaces that can be used. FIG. 6*a* shows an embodiment with spiralled ridges 60. FIG. 6*b* shows an embodiment with a knurled outer surface. FIG. 6*c* shows an embodiment with a bumpy outer surface. FIG. 6*d* shows an embodiment with segmented ridges. The features on the external tube surface have an OD that is greater than an ID of the hole 24 such that an interference fit attachment is created between the insert fitting and filter housing.

FIG. 7 shows an embodiment in which the insert fitting 28 does not have a flange 36. A bowl 64 is shown connected to the filter unit 21. It is noted that, without the flange, the bowl 64 will seal against the filter housing 20 instead of the flange. Surprisingly, this will create a downward pulling force on the insert fitting 28, pulling the insert fitting 28 out of the filter housing 20. More specifically, the insert fitting will be pulled in a downward axial direction (shown in FIG. 7). This can cause the insert fitting to be pulled from the filter housing if the filter unit 21 and bowl 64 are screwed together tightly. Embodiments lacking a flange are within the scope of the invention and appended claims.

FIG. 8 shows an embodiment in which the tube wall 42 of the insert fitting 28 is shorter than the ceramic filter 30. The ceramic flame filter 30 is partially disposed inside the insert fitting 28 and tube wall 42. In this embodiment, the retaining ring 34 can be in contact with the filter housing 20.

FIG. 9 shows an embodiment in which the ceramic flame filter 30 is disposed on top of the insert fitting. In this embodiment, the ceramic flame filter 30 is not disposed inside the insert fitting 28.

FIG. 10 shows an embodiment in which the insert fitting 28 has an eyelet portion 70 that functions as the eyelet 26 shown in FIG. 2. The eyelet portion 70 has an OD 71 greater than the filter housing hole ID (see FIG. 5). In this embodiment, the insert fitting 28 typically will not have a flange 36 because it must be inserted into the filter housing from the top (i.e. via intake 24*a*) side of the filter housing 20. However, the flange can be added (e.g. attached to the insert fitting by press fit or threaded attachment) after the insert fitting 28 has been inserted in the filter housing 20.

Also in this embodiment, the male thread OD 52 of the male threads 35 can be slightly smaller than the filter housing hole ID. This allows the male threaded portion 35 to pass through the filter housing hole 24.

The eyelet portion 70 prevents the insert fitting 28 from being pulled out of the filter housing when the bowl 64 is screwed tightly onto the male threads 35. Also, the eyelet portion 70 protects the edges of the filter housing from applied flame.

Of course, the outer surface of the insert fitting 28 in the embodiment of FIG. 10 can have ridges 40, bumps, knurling or other texturing to provide the interference fit.

FIG. 11 illustrates a method for assembling the filter unit of FIG. 10.

FIG. 12 shows another embodiment in which the insert fitting 28 has both an eyelet portion 70 and a flange 36. In this embodiment the filter housing 20 comprises two halves 20*a* 20*b* that are assembled around the insert portion 28. The filter housing halves 20*a*20*b* can attach to the insert fitting 28 by clamping/compression force. The filter housing halves 20*a* 20*b* can be assembled using adhesive or screws for example. The entire insert fitting 28 (including eyelet portion 70 and flange 36) can be monolithic, for example.

FIG. 13 shows the present vaporization pipe in operation. In operation, tobacco or other smoking material 80 is disposed in the bowl 64. A user inhales vapor 90 from the inhalation end 82 while a lighter flame exhaust 84 is directed into the flame filter unit 21. The lighter flame exhaust 84 and cold, ambient air 86 enter the flame filter 30, where they are mixed together. The exhaust 84 and air 86 combine to form an intermediate air stream 88. The air stream 88 is at vaporization temperature (e.g. 300-400 Fahrenheit), which of course heats the tobacco 80 to vaporization temperature. The temperature is manually controlled by adjusting flame application and inhalation speed. Vapor 90 is inhaled from the inhalation end 82.

The above embodiments may be altered in many ways without departing from the scope of the invention. Accordingly, the scope of the invention should be determined by the following claims and their legal equivalents.

What is claimed is:

1. A filter unit attachable to a bowl of a vaporizing pipe, comprising:

a) a filter housing having a hole with an inlet and an outlet that are fluidically connected;

b) a flame filter disposed in the hole, between the inlet and outlet;

c) an insert fitting, comprising:

1) a tube portion disposed in the hole and attached to an inner surface of the hole;

2) a male threaded portion external to the filter housing hole;

3) a flange portion located between the tube portion and the male threaded portion, and disposed outside the filter housing hole wherein the filter unit is upstream of the bowl when attached.

2. The filter unit of claim 1 wherein the insert fitting and filter housing are attached by an interference fit or adhesive.

3. The filter unit of claim 2 wherein an external surface of the tube portion comprises ridges, bumps, knurling, or texturing for facilitating the interference fit attachment.

4. The filter unit of claim 1 further comprising at least one ridge on an outer surface of the tube portion, and wherein a ridge OD is greater than an ID of the filter housing hole.

5. The filter unit of claim 1 wherein the flange has a diameter greater than an ID of the filter housing hole.

6. The filter unit of claim 1 wherein the flange has a diameter equal to or greater than an OD of the bowl.

7. The filter unit of claim 1 further comprising a step ledge for supporting the flame filter.

8. The filter unit of claim 1 wherein the flame filter is disposed inside the insert fitting.

9. The filter unit of claim 1 wherein the flame filter is disposed at least partially inside or on top of the insert fitting.

10. The filter unit of claim 1 wherein the filter housing is made of wood and has a wood grain orientation parallel with the filter housing hole.

11. The filter unit of claim 1 wherein the flange is abutted against an external surface of the filter housing.

12. A filter unit attachable to a bowl of a vaporizing pipe, comprising:

a) a filter housing having a hole with an inlet and an outlet that are fluidically connected;

b) an insert fitting, comprising:

1) a tube portion disposed in the hole, and having a non-threaded, interference fit attachment with the filter housing hole, 2) a male threaded portion external to the filter housing hole;

c) a flame filter disposed at least partially inside the insert fitting, and disposed between the inlet and outlet wherein the filter unit is upstream of the bowl when attached.

13. The filter unit of claim 12 further comprising a flange portion located between the tube portion and the male threaded portion, and disposed outside the filter housing hole.

14. The filter unit of claim 13 wherein the flange has a diameter greater than an ID of the filter housing hole.

15. The filter unit of claim 12 wherein the insert fitting further comprises an eyelet portion connected to the tube portion, and wherein the eyelet has an OD is larger than an ID of the filter housing hole.

16. The filter unit of claim 12 wherein an external surface of the tube portion comprises ridges, bumps, knurling, or texturing for facilitating the interference fit attachment.

17. The filter unit of claim 12 wherein the filter housing is made of wood and has a wood grain orientation parallel with the filter housing hole.

18. A filter unit attachable to a bowl of a vaporizing pipe, comprising:

a) a filter housing having a hole with an inlet and an outlet that are fluidically connected;

b) an insert fitting, comprising:

1) a tube portion disposed in the hole and attached to an inner surface of the hole;

2) a male threaded portion external to the filter housing hole;

3) an eyelet portion external to the filter housing hole, and having a diameter larger than the filter housing hole;

c) a flame filter disposed inside the insert fitting, and disposed between the inlet and outlet wherein the filter unit is upstream of the bowl when attached.

19. The filter unit of claim 18 wherein the insert fitting and filter housing are attached by an interference fit or adhesive.

20. The filter unit of claim 19 wherein an external surface of the tube portion comprises ridges, bumps, knurling, or texturing for facilitating the interference fit attachment.

21. The filter unit of claim 18 wherein the filter housing has a wood grain orientation parallel with the filter housing hole.

22. A vaporizing pipe, comprising:

a) a bowl having female threads;

b) a filter housing having a hole with an inlet and an outlet that are fluidically connected;

c) a flame filter disposed in the hole, between the inlet and outlet;

d) an insert fitting comprising:

1) a tube portion disposed in the hole and attached to an inner surface of the filter housing hole;

2) a male threaded portion external to the filter housing hole, for attachment to the female threads of the bowl;

3) a flange portion disposed between the tube portion and the male threaded portion, and disposed outside the filter housing hole.

23. The filter unit of claim 22 wherein the insert fitting and filter housing are attached by an interference fit or adhesive.

24. The filter unit of claim 23 wherein an external surface of the tube portion comprises ridges, bumps, knurling, or texturing for facilitating the interference fit attachment.

25. The filter unit of claim 22 further comprising at least one ridge on an outer surface of the tube portion, and wherein a ridge OD is greater than an ID of the filter housing hole.

26. The filter unit of claim 22 wherein the flange has a diameter greater than an ID of the filter housing hole.

27. The filter unit of claim 22 wherein the flange has a diameter equal to or greater than an OD of the bowl.

28. The filter unit of claim 22 further comprising a step ledge for supporting the flame filter.

29. The filter unit of claim 22 wherein the male threaded portion has an OD that is smaller than an ID of the filter housing hole.

* * * * *